US008760357B2

(12) United States Patent
Kim

(10) Patent No.: US 8,760,357 B2
(45) Date of Patent: Jun. 24, 2014

(54) WIDEBAND SINGLE RESONANCE ANTENNA

(75) Inventor: Sung-Min Kim, Gyeonggi-do (KR)

(73) Assignee: KT Corporation, Gyeonggi-do (KR)

( * ) Notice: Subject to any disclaimer, the term of this patent is extended or adjusted under 35 U.S.C. 154(b) by 121 days.

(21) Appl. No.: 13/325,118

(22) Filed: Dec. 14, 2011

(65) Prior Publication Data

US 2012/0154243 A1 Jun. 21, 2012

(30) Foreign Application Priority Data

Dec. 17, 2010 (KR) ..... 10-2010-0129831

(51) Int. Cl.
*H01Q 9/04* (2006.01)

(52) U.S. Cl.
USPC ..... 343/860; 343/700 MS

(58) Field of Classification Search
USPC ..... 343/860
See application file for complete search history.

(56) References Cited

U.S. PATENT DOCUMENTS

| | | | | |
|---|---|---|---|---|
| 6,320,549 | B1 | 11/2001 | Nybeck et al. | |
| 6,498,586 | B2 | 12/2002 | Pankinaho | |
| 6,512,493 | B2 | 1/2003 | Park et al. | |
| 6,650,294 | B2 | 11/2003 | Ying et al. | |
| 6,897,830 | B2 | 5/2005 | Bae et al. | |
| 6,963,310 | B2 | 11/2005 | Horita et al. | |
| 7,026,999 | B2 * | 4/2006 | Umehara et al. | 343/702 |
| 7,042,402 | B2 | 5/2006 | Modro | |
| 7,215,288 | B2 | 5/2007 | Park et al. | |
| 7,248,224 | B2 | 7/2007 | Yuanzhu | |
| 7,256,743 | B2 | 8/2007 | Korva | |
| 7,423,593 | B2 | 9/2008 | Puente Baliarda et al. | |
| 7,443,344 | B2 | 10/2008 | Boyle | |
| 7,755,546 | B2 | 7/2010 | Ishimiya | |
| 8,081,120 | B2 | 12/2011 | Yoshioka | |
| 8,125,390 | B2 | 2/2012 | Kuramoto et al. | |
| 2008/0007458 | A1 * | 1/2008 | Tseng et al. | 343/700 MS |
| 2009/0231213 | A1 | 9/2009 | Ishimiya | |
| 2009/0273530 | A1 * | 11/2009 | Chi et al. | 343/741 |
| 2013/0016026 | A1 * | 1/2013 | Choi et al. | 343/860 |

FOREIGN PATENT DOCUMENTS

| | | | |
|---|---|---|---|
| JP | 08-307142 | A | 11/1996 |
| JP | 2003-037418 | A | 2/2003 |
| JP | 2003-037425 | A | 2/2003 |
| JP | 2004104419 | A | 4/2004 |
| JP | 2006-180150 | A | 7/2006 |
| JP | 2006203544 | A | 8/2006 |
| JP | 2007123982 | A | 5/2007 |
| JP | 2011-055466 | A | 3/2011 |
| JP | 2011-066778 | A | 3/2011 |
| KR | 10-2003-0003647 | A | 1/2003 |
| KR | 10-2003-0015663 | A | 2/2003 |
| KR | 10-2004-0003802 | A | 1/2004 |
| KR | 10-2005-0019675 | A | 3/2005 |
| KR | 1020050025903 | A | 3/2005 |

(Continued)

*Primary Examiner* — Jerome Jackson, Jr.
*Assistant Examiner* — Andrea Lindgren Baltzel
(74) *Attorney, Agent, or Firm* — IP Legal Services, LLC

(57) ABSTRACT

Wideband single resonance antenna. An antenna may include a first conductor unit and a second conductor unit. The first conductor unit may be configured to have one end electrically coupled to a power. The second conductor unit may be configured to have one end electrically coupled to a ground, to surround at least one side of the first conductor unit, and to be electrically separated from the first conductor unit.

20 Claims, 2 Drawing Sheets

(56) References Cited

FOREIGN PATENT DOCUMENTS

| | | | |
|---|---|---|---|
| KR | 10-2005-0034172 | A | 4/2005 |
| KR | 10-2006-0070512 | A | 6/2006 |
| KR | 1020060073093 | A | 6/2006 |
| KR | 1020070025794 | A | 3/2007 |
| KR | 10-2008-0072404 | A | 8/2008 |
| KR | 10-2008-0100367 | A | 11/2008 |
| KR | 10-2009-0031969 | A | 3/2009 |
| KR | 10-2010-0013586 | A | 2/2010 |
| KR | 1020100110951 | A | 10/2010 |

* cited by examiner

WIDEBAND SINGLE RESONANCE ANTENNA

CROSS REFERENCE TO PRIOR APPLICATIONS

The present application claims priority under 35 U.S.C. §119 to Korean Patent Application No. 10-2010-0129831 (filed on Dec. 17, 2010), which is hereby incorporated by reference in its entirety.

FIELD OF THE INVENTION

Apparatuses and methods consistent with the present invention relate to an antenna, and more particularly, to a single resonance antenna supporting wideband.

BACKGROUND OF THE INVENTION

A user equipment has been advanced so as to be able to receive various services such as a communication service including a voice call service and a short message service, and a multimedia service including a streaming service and a digital multimedia broadcasting (DMB) service. In order to support such services, a user equipment is required to have an antenna for receiving corresponding signals. Since the communication services and the multimedia services are provided through different frequency bands, an antenna supporting wideband and multiple band characteristics has been demanded.

Lately, there is a demand for a user equipment supporting various services such as a code division multiple access (CDMA) service, a personal communication service (PCS) service, a Wi-Fi service, and a WiMax service, which are provided through multiple bands. Furthermore, it is expected that such demands will be abruptly increased in the near future.

In order to receive such services, a user equipment is required to have an antenna having wideband characteristics. Due to portability and user convenience, the antenna for the user equipment is also required to be slim and small-sized. However, it is very difficult to design and manufacture an antenna to be slim and small sized while supporting wideband characteristics.

A planner inverted F-antenna has been widely used as an antenna for a user equipment. The planner inverted F-antenna has a low profile and proper omni directionality. However, it is difficult to design a planner inverted F-antenna to have wideband characteristics.

A branch antenna having a plurality of resonator holes has been introduced to support wideband characteristics. Such branch antenna has been generally equipped with a user equipment. The branch antenna needs to have a plurality of current paths. Accordingly, it is difficult to make the branch antenna to be small-sized because of the plurality of current paths.

SUMMARY OF THE INVENTION

Embodiments of the present invention overcome the above disadvantages and other disadvantages not described above. Also, the present invention is not required to overcome the disadvantages described above, and an embodiment of the present invention may not overcome any of the problems described above.

In accordance with an aspect of the present invention, an antenna may have wideband characteristics while having a comparatively small size.

In accordance with another aspect of the present invention, an antenna may have a single resonance point structure while providing wideband characteristics.

In accordance with still another aspect of the present invention, an antenna may have a first conductor unit performing a coupling feed and a second conductor unit performing functions of a radiator, which surrounds the first conductor unit and is electrically separated from the first conductor unit.

In accordance with an embodiment of the present invention, an antenna may include a first conductor unit and a second conductor unit. The first conductor unit may be configured to have one end electrically coupled to a power source. The second conductor unit may be configured to have one end electrically coupled to a ground, to surround at least one side of the first conductor unit, and to be electrically separated from the first conductor unit.

The first conductor unit may include a first horizontal member and a first vertical member. The first horizontal member may be configured to extend in a first direction. The first vertical member may be configured to extend in a direction perpendicular to the first direction, to have one end electrically coupled to the power feeder and the other end coupled to the first horizontal member.

The first conductor unit may further include an open stub disposed at a location at which the horizontal member meets the first vertical member. A size of the open stub may be controlled based on a degree of impedance matching required for the antenna.

The first conductor unit may have a shape of about "ㄱ".

The second conductor unit may include a second horizontal member and a second vertical member. The second horizontal member may be configured to extend in the first direction, to be electrically separated from the first horizontal member of the first conductor unit, and to surround at least one side of the first horizontal member of the first conductor unit. The second vertical member may be configured to extend in parallel with the first vertical member, to be electrically separated from the first vertical member, and to have one end coupled to the ground and the other end coupled to the second horizontal member.

The second vertical member may have a tapered structure that extends in parallel with the first vertical member and becomes narrower.

The second vertical member may have a tapered side formed at one side of the second vertical member, which is opposite to a side of the second vertical member, which faces the first vertical member.

The second vertical member may have a tapered side formed at one side of the second vertical member, which faces the first vertical member.

The second horizontal member may have a shape of about "ㄱ".

A distance between the first conductor unit and the second conductor unit may be decided based on a coupling feed corresponding to a use frequency of the antenna.

The first conductor unit may perform a coupling feed, and the second conductor unit may operate as a radiator through the coupling feed of the first conductor unit.

The second conductor unit may have single resonance point structure.

In accordance another embodiment of the present invention, an antenna may include a first conductor unit and a second conductor unit. The first conductor unit may be configured to perform a coupling feed and to include a first vertical member and a first horizontal member. The second conductor unit may be configured to surround at least three sides of the first conductor unit and to operate as a radiator by electrical coupling generated in at least three regions and to include a second vertical member and a second horizontal member.

One end of the first vertical member of the first conductor unit may be electrically coupled to a power feeder, and one end of the second vertical member of the second conductor unit may be electrically coupled to a ground.

One side of the second vertical member may be a tapered side.

The second conductor unit may have a single resonance point structure.

The first conductor unit and the second conductor unit may be electrically separated by a distance. The distance may be decided based on a use frequency.

A radiating frequency of the antenna may be decided based on an electric length of the second conductor unit.

BRIEF DESCRIPTION OF THE DRAWINGS

The above and/or other aspects of the present invention will become apparent and more readily appreciated from the following description of embodiments, taken in conjunction with the accompanying drawings, of which.

DETAILED DESCRIPTION OF THE INVENTION

Figure 1:
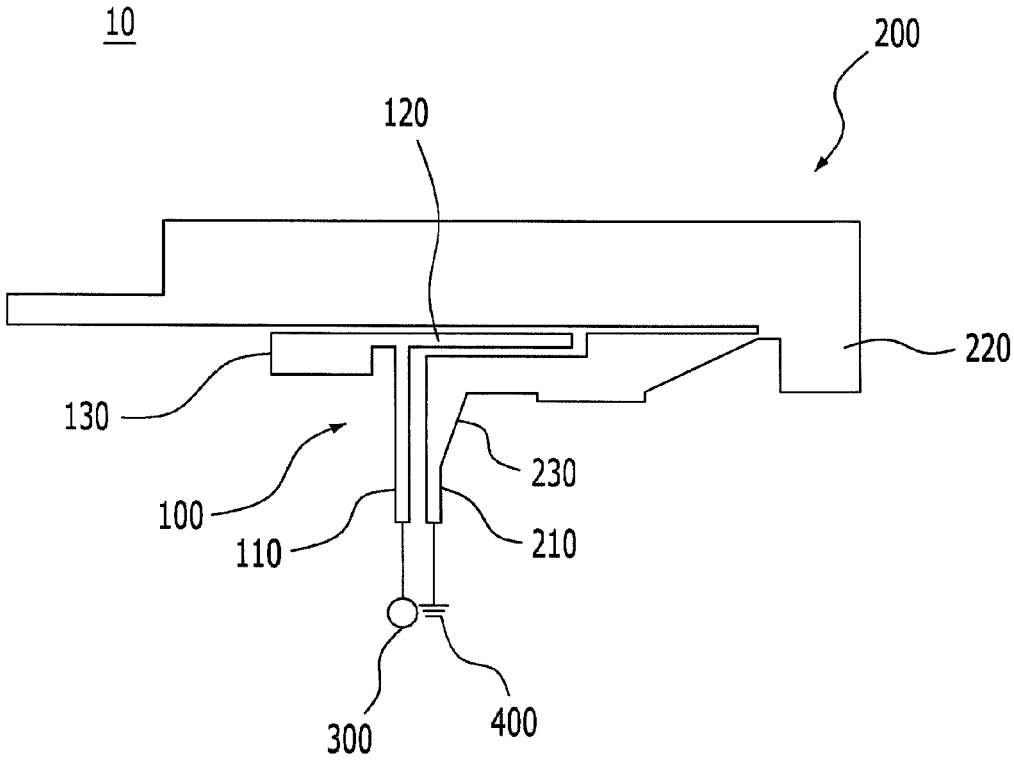
FIG. 1 illustrates an antenna in accordance with an embodiment of the present invention.

Reference will now be made in detail to embodiments of the present invention, examples of which are illustrated in the accompanying drawings, wherein like reference numerals refer to like elements throughout. The embodiments are described below, in order to explain the present invention by referring to the figures.

In accordance with an embodiment of the present invention, an antenna may have wideband characteristics while maintaining a comparatively small size. Such an antenna may have a single resonance point structure. Furthermore, the antenna may include a first conductor unit performing a coupling feed and a second conductor unit operating as a radiator. The second conductor unit may surround the first conductor unit and may be electrically separated from the first conductor unit. The second conductor unit may have a vertical member having a tapered structure that provides various coupling coefficients with the first conductor unit, thereby providing wideband characteristics.

FIG. 1 illustrates an antenna in accordance with an embodiment of the present invention.

Referring to FIG. 1, an antenna 10 may include a first conductor unit 100 and a second conductor unit 200. The first conductor unit 100 may be electrically coupled with a power feeder 300. The second conductor unit 200 may be electrically coupled with a ground 400. The first conductor unit 100 may be electrically separated from the second conductor unit 200 by a certain distance. The second conductor unit 200 may surround at least one side of the first conductor unit 100. For example, the second conductor unit 200 may surround more than three sides of the first conductor unit 100 while being separated by a certain distance, as shown in FIG. 1. The present invention, however, is not limited thereto.

The first conductor unit 100 may have a bended shape. For example, the first conductor unit 100 may have a shape of "ㄱ". Such a first conductor unit 100 may include a first vertical member 110 and a first horizontal member 120.

The first horizontal member 120 may extend in a first direction. For example, the first horizontal member 120 may be parallel with one side of the second conductor unit 200 and separated from the one side by a certain distance. The first horizontal member 120 may have one end coupled to the first vertical member 110 and the other end open.

The first vertical member 110 may extend in a direction perpendicular to the first horizontal member 120. The first vertical member 110 may include one end that is electrically coupled with the power feeder 300 and another end coupled to the first horizontal member 120.

The first conductor unit 100 may further include an open stub 130. The open stub 130 may be coupled at a bended portion of the first conductor unit 100. For example, the open stub 130 may be disposed at the location where the first horizontal member 120 meets the first vertical member 110. In accordance with an embodiment of the present invention, the open stub 130 may be disposed for impedance matching. A size of the open stub 130 may be controlled based on a degree of required impedance matching.

The first conductor unit 100 and the second conductor unit 200 may be electrically separated. The first conductor unit 100 may perform coupling feed to feed power to the second conductor unit 200. In general, unlike typical coupling feed, the first conductor unit 100 may perform a coupling feed along a comparatively long region. In order to perform such a coupling feed, the first conductor unit 100 may have a bended shape such as "ㄱ".

The second conductor unit 200 may be electrically separated from the first conductor unit 100 by a certain distance. The second conductor unit 200 may surround at least one side of the first conductor unit 100. Accordingly, the second conductor unit 200 may be formed as a shape so as to surround at least one side of the first conductor unit 100. For example, the second conductor unit 200 may have a shape of about "ㄱ".

The second conductor unit 200 may include a second vertical member 210 and a second horizontal member 220. The second horizontal member 220 may extend in the first direction. For example, the second horizontal member 220 may extend in a direction parallel to the first horizontal member 120 of the first conductor unit 100. The second horizontal member 220 may be longer than the first horizontal member 120. The second horizontal member 220 may be formed in a shape so as to surround the first horizontal member 120 of the first conductor unit 100. For example, the second horizontal member 220 may be formed in a shape of about "ㄱ".

The second vertical member 210 may extend in a direction perpendicular to the first direction. For example, the second vertical member 210 may extend in parallel with the first vertical member 110. Furthermore, the second vertical member 210 may be electrically separated from the first vertical member 110. A distance between the first and second vertical members 110 and 210 may be controlled based on a use frequency. For example, the first and second vertical members 110 and 210 may be separated by any distance that still allows for a coupling feed in correspondence with a use frequency.

The second vertical member 210 may have a tapered shape that becomes gradually narrower while extending in parallel with the first vertical member 110. For example, the second vertical member 210 may have one tapered side 230.

As shown in FIG. 1, the tapered side 230 may be formed at a side of the second vertical member 210 that is opposite to a side facing the first vertical member 110 of the first conductor unit 100. However, the present invention is not limited thereto. In accordance with another embodiment of the present invention, the tapered side 230 may be formed at a side of the second vertical member 200 that faces the first vertical member 110 of the first conductor unit 100.

Such a tapered shape of the second vertical member 210 of the second conductor unit 200 may be a core structure for obtaining wideband characteristics in accordance with an embodiment of the present invention. For example, the tapered side 230 may cause various coupling coefficients with the first conductor unit 100. Due to the various coupling coefficients, the antenna 10 may have wideband characteristics.

As described above, the second horizontal member 220 may be formed in a shape that surrounds at least one side of the first conductor unit 100, for example, a shape of about "ㄱ". Due to the shape of the second horizontal member 220, an open space may be formed between the second horizontal member 220 and the second vertical member 210. The first conductor unit 100 may be disposed in the open space. For example, the second horizontal member 220 may be formed to surround at least three sides of the first horizontal member 120 of the first conductor unit 100.

Since the second horizontal member 220 of the second conductor unit 200 may surround at least three sides of the first horizontal member 120 of the first conductor unit 100, electrical coupling may be generated at three regions between the first horizontal member 120 of the first conductor unit 100 and the second horizontal member 220 of the second conductor unit 200. That is, electrical coupling may be generated at sides of the second horizontal member 220 that surround the first horizontal member 120 of the first conductor unit 100.

In accordance with an embodiment of the present invention, electrical coupling may be generated at four regions of the antenna 10. For example, electrical coupling may be generated from the first horizontal member 120 of the first conductor unit 100 to three sides of the second horizontal member 220 of the second conductor unit 200, and another electrical coupling may be generated from the first vertical member 110 of the first conductor unit 100 to the second vertical member 210 of the second conductor unit 200.

As described above, the antenna 10 in accordance with an embodiment of the present invention may generate electrical coupling at more than four regions between the first conductor unit 100 and the second conductor unit 200. Accordingly, the antenna 10 may have wideband characteristics.

The second conductor unit 200 may operate as a radiator that radiates a radio frequency signal through a coupling feed from the first conductor unit 100. In accordance with an embodiment of the present invention, a radiating frequency of the antenna 10 may be decided based on an electrical length of the second conductor unit 200.

The second conductor unit 200 may have a single resonance point structure. Such a single resonance point structure does not require additional branches like a multi-resonance point structure that forms a plurality of current paths through a plurality of branches would require. Accordingly, it may be possible to form the second conductor unit 200 in a small size.

The antenna in accordance with an embodiment of the present invention may be assembled with a carrier or a printed circuit board (PCB) and installed inside a user equipment. Furthermore, the antenna in accordance with an embodiment of the present invention may be assembled with a planar carrier or a substrate. For example, the antenna in accordance with an embodiment of the present invention may be coupled to a bended carrier.

Figure 2:
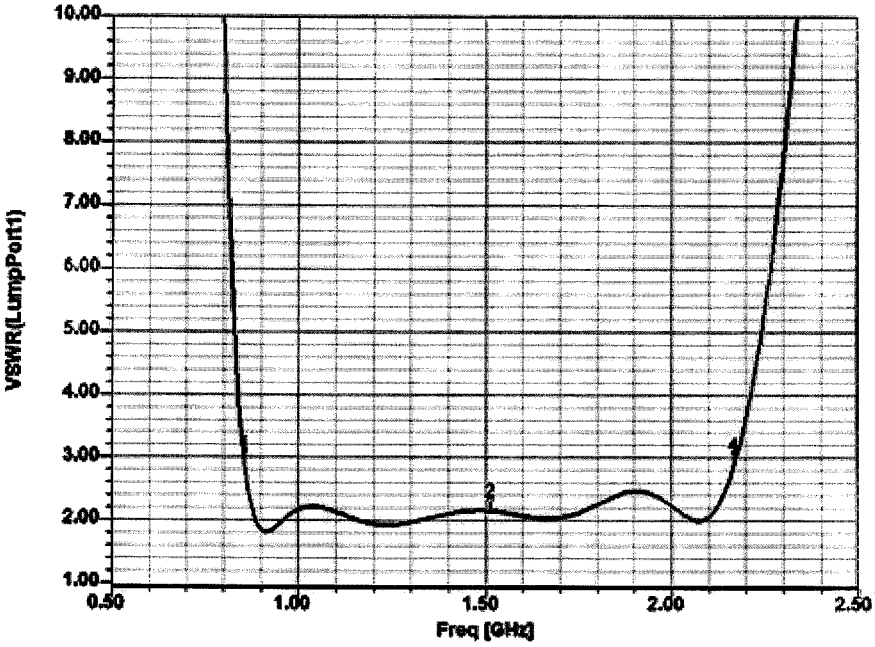
FIG. 2 is a graph that illustrates a voltage standing wave ratio (VSWR) of an antenna in accordance with an embodiment of the present invention.

FIG. 2 is a graph that illustrates a voltage standing wave ratio (VSWR) of an antenna in accordance with an embodiment of the present invention.

Referring to FIG. 2, the VSWR graph shows an antenna 10 in accordance with an embodiment of the present invention having wideband characteristics. For example, the antenna may receive or transmit a RF signal from about 0.8 GHz band to about 2.2 GHz band.

Although the antenna 10 has a single resonance structure, the antenna 10 can support not only a low frequency service such as a CDMA service or a PCS service but also a high frequency service such as a WCDMA service or a WiBro service. Since the antenna 10 has a single resonance structure, the antenna 10 may be manufactured in a comparatively smaller size, as compared to an antenna having a multi-resonance point structure, while sustaining wideband characteristics, for example, from about 0.8 GHz band to about 2.2 GHz.

As described above, the antenna 10 may be manufactured in a comparatively small size while providing wideband characteristics with a single resonance structure.

Furthermore, the antenna in accordance with an embodiment of the present invention can obtain wideband characteristics using a small radiator having a single resonance structure.

The term "coupled" has been used throughout to mean that elements may be either directly connected together or may be coupled through one or more intervening elements.

Although embodiments of the present invention have been described herein, it should be understood that the foregoing embodiments and advantages are merely examples and are not to be construed as limiting the present invention or the scope of the claims. Numerous other modifications and embodiments can be devised by those skilled in the art that will fall within the spirit and scope of the principles of this disclosure, and the present teaching can also be readily applied to other types of apparatuses. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna comprising;

a first conductor unit configured to have one end electrically coupled to a power feeder; and a second conductor unit configured to have a tapered structure having one end electrically coupled to a ground, and configured to surround at least three sides of the first conductor unit and to be electrically separated from the first conductor unit.

2. The antenna of claim 1, wherein the first conductor unit comprises:

a first horizontal member configured to extend in a first direction; and a first vertical member configured to extend in a direction perpendicular to the first direction, and configured to have the one end electrically coupled to the power feeder and another end coupled to the first horizontal member.

3. The antenna of claim 2, wherein the first conductor unit further comprises:

an open stub disposed at a location where the first horizontal member meets the first vertical member.

4. The antenna of claim 3, wherein a size of the open stub is controlled based on a degree of impedance matching required for the antenna.

5. The antenna of claim 2, wherein the first conductor unit has a shape of about "I".

6. The antenna of claim 2, wherein the second conductor unit comprises:

a second horizontal member configured to extend in the first direction, and configured to be electrically separated from the first horizontal member of the first conductor unit and to surround the at least three sides of the first horizontal member of the first conductor unit; and a second vertical member configured to extend in parallel with the first vertical member, and configured to be electrically separated from the first vertical member and to have the one end coupled to the ground and another end coupled to the second horizontal member.

7. The antenna of claim 6, wherein the second vertical member comprised the tapered structure that extends in parallel with the first vertical member and becomes narrower toward the one end coupled to the ground.

8. The antenna of claim 6, wherein the second vertical member comprises a tapered side opposite to a side of the second vertical member that faces the first vertical member.

9. The antenna of claim 6, wherein the second vertical member comprises a tapered side that faces the first vertical member.

10. The antenna of claim 6, wherein the second horizontal member has a shape of about "⊐".

11. The antenna of claim 1, wherein a distance between the first conductor unit and the second conductor unit is decided based on a coupling feed in correspondence with a frequency of the antenna.

12. The antenna of claim 1, wherein:

the first conductor unit performs a coupling feed; and the second conductor unit performs functions of a radiator through the coupling feed of the first conductor unit.

13. The antenna of claim 1, wherein the second conductor unit has a single resonance point structure.

14. An antenna comprising:

a first conductor unit configured to perform a coupling feed and configured to include a first vertical member and a first horizontal member; and a second conductor unit configured to surround at least three sides of the first conductor unit, configured to operate as a radiator by electrical coupling generated in at least three regions of the antenna, and configured to include a second vertical member and a second horizontal member, wherein the second conductor unit has a tapered structure becoming narrower toward one end electrically coupled to a ground.

15. The antenna of claim 14, wherein:

one end of the first vertical member of the first conductor unit is electrically coupled to a power feeder; and one end of the second vertical member of the second conductor unit is electrically coupled to the ground.

16. The antenna of claim 14, wherein one side of the second vertical member is a tapered side.

17. The antenna of claim 14, wherein the second conductor unit has a single resonance point structure.

18. The antenna of claim 14, wherein the first conductor unit and the second conductor unit are electrically separated by a distance.

19. The antenna of claim 18, wherein the distance is dependent upon a frequency of the antenna.

20. The antenna of claim 14, wherein a radiating frequency of the antenna is dependent upon an electric length of the second conductor unit.

* * * * *